US005246028A

United States Patent [19]

Vandepas

[11] Patent Number: 5,246,028

[45] Date of Patent: Sep. 21, 1993

[54] SANITARY YARD HYDRANT

[75] Inventor: Robert J. Vandepas, Colorado Springs, Colo.

[73] Assignee: WCM Industries, Inc., Colorado Springs, Colo.

[21] Appl. No.: 938,933

[22] Filed: Sep. 1, 1992

[51] Int. Cl.[5] ..... E03B 7/12; E03B 9/14

[52] U.S. Cl. ..... 137/282; 137/301; 138/32; 417/187

[58] Field of Search ..... 137/282, 286, 287, 288, 137/301, 302, 59, 62, ; 138/27, 32, 35; 417/151, 187; 239/104, 106, 124

[56] References Cited

U.S. PATENT DOCUMENTS

| | | | |
|---|---|---|---|
| 2,580,199 | 12/1951 | Schmid | 137/301 |
| 2,598,488 | 5/1952 | Bart | 137/282 |
| 2,605,781 | 8/1952 | Schmid et al. | 137/301 |
| 2,664,096 | 12/1953 | Murdock et al. | 137/301 |
| 3,017,896 | 11/7962 | Papacek | 137/282 |
| 3,070,116 | 12/1962 | Noland et al. | 137/302 |
| 3,885,585 | 5/1975 | Carpentier | 137/282 |
| 4,109,671 | 8/1978 | Hughes et al. | 137/282 |
| 4,112,966 | 9/1978 | Carlson | 137/282 |
| 4,653,521 | 3/1987 | Fillman et al. | 137/301 |
| 4,653,522 | 3/1987 | Fillman et al. | 137/301 |
| 4,854,339 | 8/1989 | Hoeptner, III | 137/301 |
| 5,033,500 | 7/1991 | Hoeptner, III | 137/301 |

*Primary Examiner*—George L. Walton
*Attorney, Agent, or Firm*—Zarley, McKee, Thomte, Voorhees & Sease

[57] ABSTRACT

A freeze and contamination resistant hydrant, for controlling fluid flow includes: a vertically elongated conduit having a lower portion adapted for installation underground, the conduit having a lower fluid inlet associated with that lower portion, and an upper fluid outlet, for passing fluid; a valve in the lower portion of the conduit; a plunger, with a stopper of substantially circular horizontal cross-section attached, extending downward through the conduit into the valve for closing and opening the same; an upper drain port in the valve above the stopper drains any fluid trapped above the valve when the valve is closed; a venturi conduit below the valve having a venturi port; and a fluid reservoir surrounding at least the lower portion of the conduit. When the valve is opened, fluid passes from the lower fluid inlet to the upper fluid outlet and through the venturi conduit to induce fluid flow from the reservoir through the venturi port. When the valve is closed, fluid is prevented from flowing from the lower fluid inlet to the upper fluid outlet, and fluid above the valve is drained into the reservoir through the drain port.

7 Claims, 2 Drawing Sheets

SANITARY YARD HYDRANT

BACKGROUND OF THE INVENTION

This invention relates to yard hydrants, and more particularly to yard hydrants which resist freeze-up in cold weather while keeping ground water and other contaminants from commingling with the fluid pumped through the hydrant.

Freezeless yard hydrants are old in the art, and conventionally have a drain release valve in the bottom portion thereof which is located below the frost line, and which opens when the main hydrant valve is closed. Thus, when this takes place, water ceases to flow from the fluid outlet above the ground surface, and water within the hydrant drains therefrom into the surrounding soil or rock bed adjacent the drain release valve below the frost line. While this system works well to solve the chance of water freezing within the hydrant, some danger exists that contaminated outside water might enter the hydrant.

Some attempts have been made to solve this problem by using a reservoir around the hydrant below the frost line, which will collect residual water in the hydrant when it is shut off. However, units are apt to fill and overflow the reservoir when a hose is attached to the hydrant. However, such existing designs do not adapt themselves for use with conventional yard hydrant structures.

With the increased public concern over the effects of pecticides and other pollutants on ground water, there is a need for a valve which isolates the reservoir fluid from surrounding ground water. There is a need for a simple, reliable valve that does not require heating by electricity or other means and will resist freeze-up during normal winter conditions without allowing contamination.

Therefore, a principal object of this invention is to provide a conventional ground hydrant structure in combination with a surrounding reservoir, wherein residual water in the hydrant is directed to the reservoir when the hydrant is closed to flow, and where water in the reservoir is removed therefrom during flow conditions by means of a venturi and check valve means.

A further object of the present invention is to provide a sanitary yard hydrant resistant to freezing and contamination.

Another object of the present invention is to provide a sanitary yard hydrant which has a check valve in conjunction with a reservoir to prevent flow of water from below the check valve into the reservoir under reduced flow conditions.

A further object of the invention is to provide a combination hydrant and reservoir wherein the hydrant can be removed from the reservoir without removing the reservoir from the ground.

SUMMARY OF THE INVENTION

The invention provides a sanitary yard hydrant which is resistant to freeze-up and contamination by ground water. The apparatus is adapted to control fluids, such as water, and includes a first vertical pipe whose lower portion is adapted for underground installation and which has a lower inlet and an upper outlet for passing fluid. This first pipe has a valve body with a narrowed passage forming a valve seat. A plunger extends down the first pipe and into the valve body. A handle operates a plunger to raise and lower a stopper having a circular horizontal cross-section into sealed engagement with the valve seat to control the flow of fluid through the hydrant. A second pipe surrounds the first pipe and has a bottom sealed to the outside of the first pipe to define a reservoir for fluid between the two pipes. The bottom of the first pipe is frictionally but detachably sealed to the bottom of the reservoir. Two ports communicate fluid between the reservoir and the interior of the first pipe. A drain port is located above the valve seat, but below the ground frost line, to prevent freeze-up. Thus, any fluid above that point drains into the reservoir when the stopper is seated to shut the hydrant off. A venturi port, having a check valve for unidirectional flow from the reservoir, is located on the first pipe below the valve seat. An adjacent narrowed passage acts as a venturi and induces fluid to flow from the reservoir and join fluid in the first pipe when the stopper is unseated to turn the hydrant on. Thus, the reservoir drains the portion of the hydrant which is above the frost line when the hydrant is shut off and the reservoir is emptied each time the hydrant is turned on. Since no fluid is left above the frost line when the hydrant is off, freeze-up is prevented. Particulate and ground water contamination of the reservoir is also prevented since the top of the pipe is covered and extends above ground. A vent valve in the cover ensures proper filling and emptying of the reservoir.

BRIEF DESCRIPTION OF THE DRAWINGS

FIG. 4 is a sectional view which is taken along line 4—4 of FIG. 2 and shows greater detail of the valve body and venturi pipe when the hydrant is on.

DESCRIPTION OF THE PREFERRED EMBODIMENT

Figure 1:
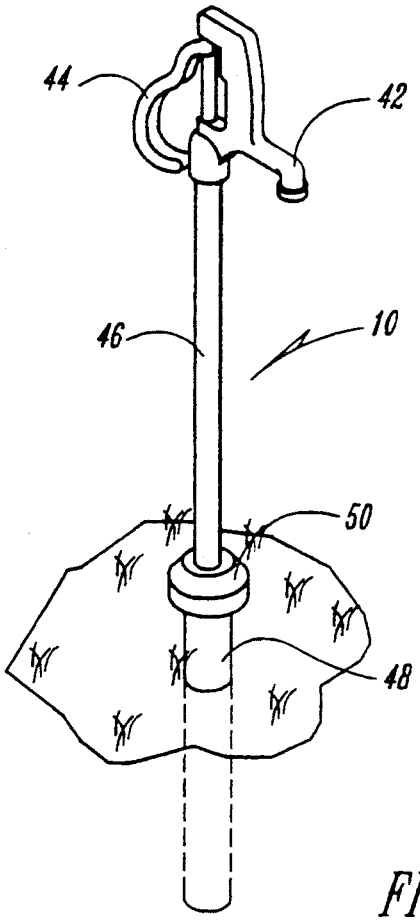
FIG. 1 is a perspective view of the sanitary yard hydrant of this invention as normally installed.

The freeze and contaminant resistant sanitary yard hydrant of this invention is designated by the reference numeral 10 in the drawings.

Figure 2:
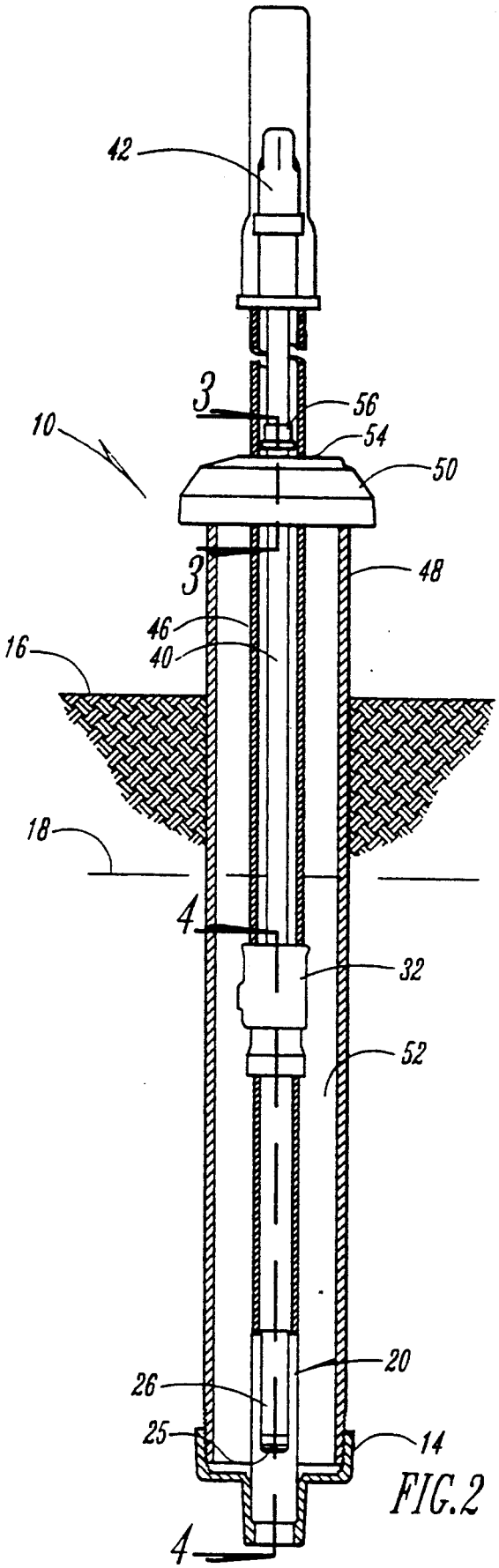
FIG. 2 is a sectional view of the hydrant of this invention taken along its vertical axis.
Figure 4:
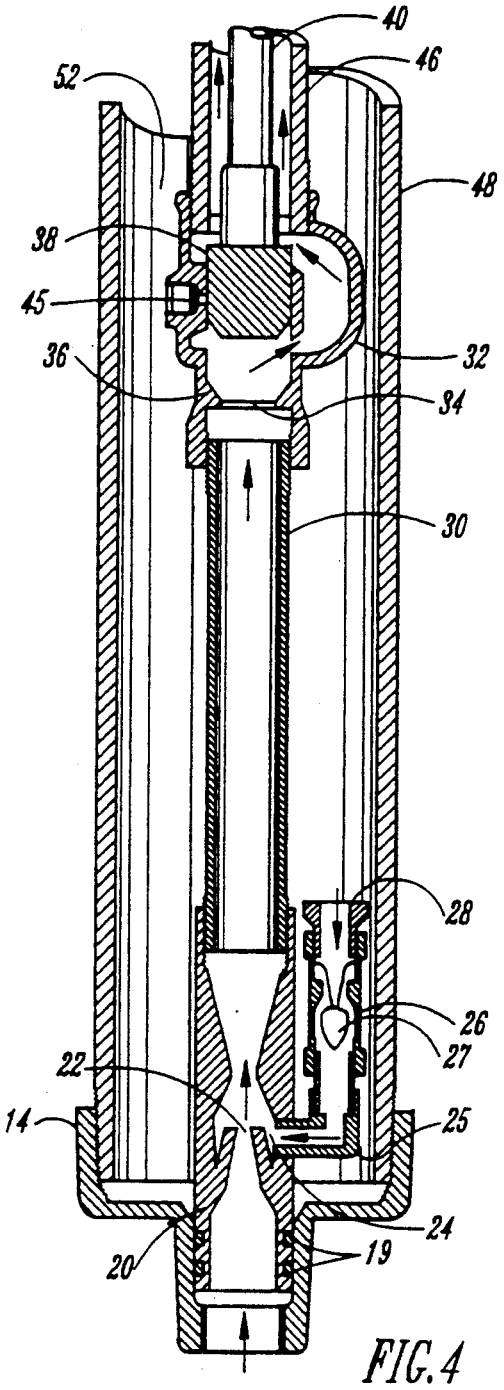

As generally shown in FIG. 1, the hydrant 10 is adapted to receive, control, and dispense fluid from an underground source. Referring to FIG. 2, the fluid is supplied by the underground source through a hollow inlet casing 14 at the bottom of hydrant 10 which is connected in sealed engagement with an inlet pipe (not shown) below the ground. The connection is located a sufficient distance below ground level 16 and frost line 18 so that the fluid will not freeze under normal winter conditions. As shown in FIG. 4, the inlet casing 14 is also located in detachable sealed engagement with a venturi pipe 20. O-rings 19 may be used to seal this connection from fluid leakage.

Referring to FIG. 4, the venturi pipe 20 has a narrowed passage 22 positioned to increase pressurized fluid flow velocity in proximity to venturi port 24. Venturi port 24, in the side of the venturi pipe 20, is fitted with a small, elbow-shaped brass pipe 25 which in turn extends upwardly and is connected to a check valve cartridge 26 which permits fluid to flow only toward venturi port 24. The check valve 27 may be of ball and spring, floating ball, or similar construction. The upper end of the check valve cartridge is also covered with a screen 28 to keep particulate contamination from entering the venturi pipe 20.

Figure 5:
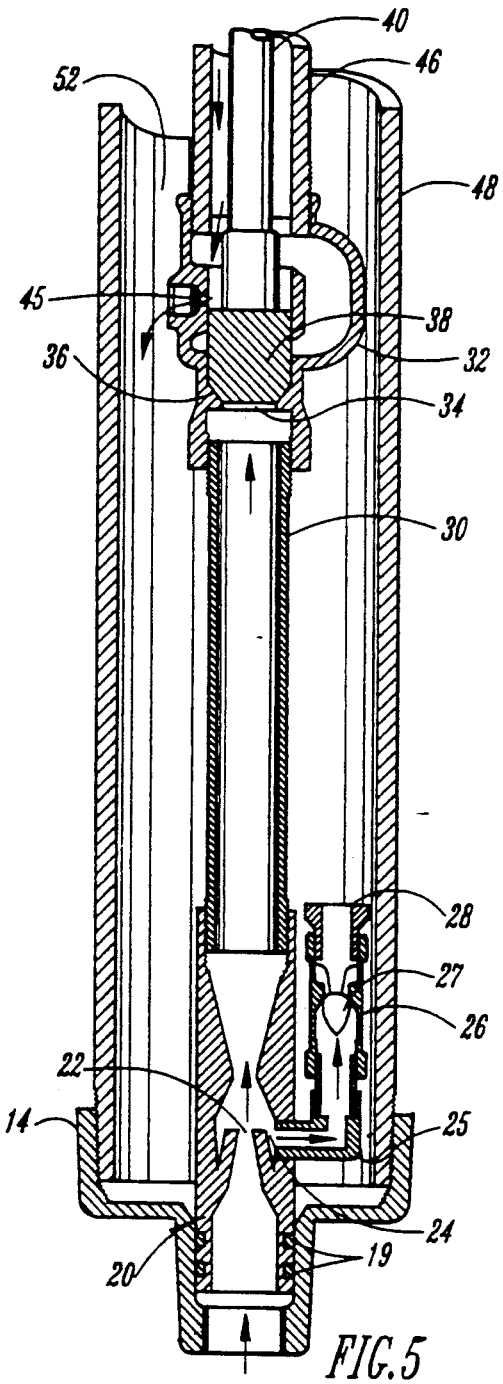
FIG. 5 is a sectional view of the same area as shown in FIG. 4, but shows the valve body and venturi pipe when the hydrant is off.

At its upper end, the venturi pipe 20 is fluidly connected directly to a valve body 32 via hollow riser pipe 30. The inside of valve body 32 has a narrowed passage 34 defining a seat 36 for a stopper 38. Stopper 38 is tapered in diameter and has a substantially circular horizontal cross-section. FIG. 5 shows the stopper 38 resting on valve body seat 36. With the stopper in this position, fluid is prevented from moving through the narrowed passage 34 in valve body 32. Stopper 38 is connected to a plunger 40 which can be seen in FIG. 2 to extend above the ground level 16 into faucet head 42 where handle 44 is operatively attached for raising and lowering the plunger 40 and, thus, unseating and seating the stopper 38. When the stopper 38 is seated, a valve body drain port 45 is uncovered, allowing fluid above the drain port to drain into the reservoir 52 below. An upper pipe 46 has a lower end fluidly connected to the valve body 32 and an upper end in sealed engagement with the head 42 for dispensing fluid. For example, these connections may be achieved with pipe threads.

Figure 3:
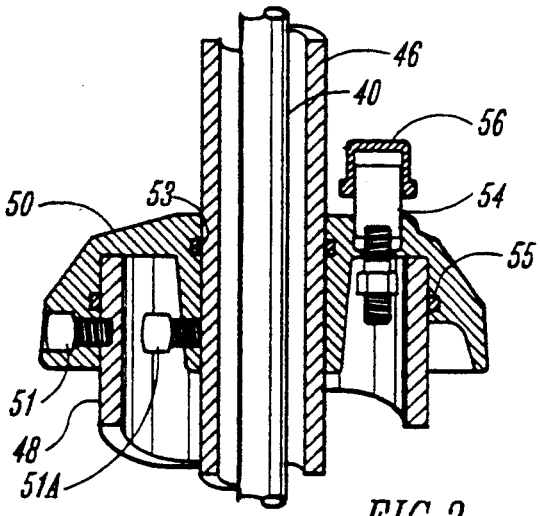
FIG. 3 is a sectional view which is taken along line 3—3 of FIG. 2 and shows the cover of the hydrant in greater detail.

Referring to FIG. 2, an outer pipe 48, preferrably made of a plastic material to resist corrosion and of sufficient inside diameter to enclose the valve body 32 and venturi 20 with check valve 26, is in sealed engagement, for example by pipe threads, with the upper throat of the inlet casing 14. The outer pipe 48 extends upward to a point above frost line 18 and ground level 16 and into a cover 50. FIG. 3 shows that cover 50 is held in sealed engagement with the upper pipe 46 and outer pipe 48, for example by clamp screws 51 and 51A, inner O-ring 53 and outer O-ring 55. Thus, as can be seen in FIG. 2, a sealed reservoir 52 for holding fluid is defined inside the outer pipe 48 above the inlet casing 14. FIG. 3 shows that cover 50 includes a vent 54 for communicating air with the fluid reservoir 52 and relieving pressure therefrom. The vent 54 has a vent cap 56 for keeping contaminants out of the fluid reservoir 52.

OPERATION OF THE INVENTION

With the handle 44 in a down, off or closed position like in FIG. 1, the plunger 40 seats the stopper 38 as shown in FIG. 5, on seat 36 to block the narrowed passage 34. Fluid from the underground source is kept below the ground frost line 18 and cannot flow to head 42. Seating the stopper 38 also uncovers the valve body drain port 45 and allows any fluid trapped above the port 45, from the last operation of the hydrant, to drain into the reservoir 52. Therefore, it is possible with the present invention to keep any fluid in the hydrant below the frost line when the hydrant is turned off. Since it is below the frost line and receives stored heat from the surrounding ground, such fluid will not freeze. As shown in FIG. 3, the vent valve 54 and cap 56 in the cover 50 allow the reservoir 52 to breathe and ensure that the fluid will not overflow the reservoir.

Handle 44 may also be moved to an up, on, or open position which moves the plunger 40 in an upward direction. FIG. 4 shows that the stopper 38 attached to plunger 40 is unseated, blocking valve body port 45 and opening the narrowed passage 34 for fluid to flow through the valve body 32. Thus, fluid is permitted to flow from the underground source through the hydrant 10 and dispensed out the head 42. The movement of fluid through the narrow passages 22 in the venturi 20 increases the pressurized fluid flow velocity in proximity to the venturi port 24. The upward velocity of fluid exiting from passage 22 is enhanced, so that associated fluid pressure is reduced. Therefore, fluid that was drained into the reservoir 52 from the upper portion of the hydrant when the hydrant was closed is induced through check valve 27 via venturi port 24 into the fluid stream passing to head 42 when the hydrant is opened. As a result, the reservoir 52 above the level of the venturi port 24 is emptied or substantially emptied when the hydrant is opened. Check valve 27 operates to insure that fluid flow goes out of, rather than into, the reservoir at venturi port 24.

Check valve 27 also prevents filling and flooding of the reservoir 52 under such reduced flow conditions as when back pressure from a hose connected to the hydrant is experienced.

If it is desired to remove the hydrant assembly from the reservoir pipe 48 for repair, the screw 51 (FIG. 3) is loosened to free it from engagement with pipe 48. This serves to release cover 50 from pipe 48. The pipe 46 with the cover still attached (by screw 51A) can then be lifted vertically. With reference to FIGS. 4 and 5, the frictional seal of O-rings 19 is overcome and the lower end of venturi pipe 20 is slidably removed from the lower end of inlet casing 14. The hydrant assembly can be re-installed in the pipe 48 by reversing the above procedure.

It is therefore seen that this invention will accomplish at least its stated objectives.

What is claimed is:

1. A sanitary yard hydrant, comprising:

a vertical elongated fluid conduit having a lower portion adapted for installation underground, said lower portion having upper and lower ends;

a valve means in said conduit adjacent the upper end of said lower portion to control flow of fluid through said conduit;

a plunger extending downwardly in said conduit for opening and closing said valve means;

a fluid reservoir surround the lower portion of said conduit and extending from said valve means downwardly to the lower end of said conduit;

a drain port in said valve means for draining fluid from said conduit above said vale means when said valve means is closed;

said fluid reservoir in communication with said drain port of said valve means;

a venturi passageway located at the lower end of said lower portion of said conduit;

a second fluid conduit secured to said venture passageway and communication with said reservoir, and a check valve means in said second fluid conduit to permit fluid to flow from said reservoir into said second fluid conduit, but to prevent fluid from flowing into said reservoir from said second fluid conduit, whereby fluid in said reservoir may flow by gravity and venturi action downwardly through said second conduit towards said venturi passageway when the fluid level in said reservoir is above the uppermost end of said second passageway, during the time when said valve means is open and the drain port is closed by said valve means, and fluid is flowing upwardly through said venturi passageway; and whereby said check valve means will close to prevent fluid flow from said venturi passageway into said fluid reservoir through said second conduit when the fluid level in said reservoir is below the uppermost end of said second passageway regardless of the position of the valve means.

2. The apparatus of claim 1 wherein a check valve is positioned between said venturi passageway and said reservoir to permit flow of fluid from said reservoir to said venturi passageway, but to prevent flow of fluid from said venturi passageway to said reservoir.

3. The apparatus of claim 1 wherein said reservoir extends above ground level.

4. The apparatus of claim 1 wherein said reservoir includes a cover for sealing said reservoir to said conduit.

5. The apparatus of claim 4 including a vent valve communicating with said reservoir and extending toward an outlet above ground level to pass air into said reservoir when fluid flows from said reservoir into said venturi conduit and prevent overflow and over-pressurization when fluid is drained.

6. The apparatus of claim 1 where said reservoir is cylindrical and substantially coaxial with said plunger and valve means.

7. The hydrant of claim 1 wherein said check valve means is located within said reservoir.

* * * * *